United States Patent [19]

Fulp et al.

[11] 4,086,546

[45] Apr. 25, 1978

[54] UNIVERSAL ATTENUATOR

[75] Inventors: William W. Fulp; Jack G. Nance, both of Winston-Salem; James L. Owens, Clemmons; Theodore W. Robbins, Winston-Salem, all of N.C.

[73] Assignee: Western Electric Company, Inc., New York, N.Y.

[21] Appl. No.: 755,402

[22] Filed: Dec. 29, 1976

[51] Int. Cl.[2] ..... H01P 1/22

[52] U.S. Cl. ..... 333/81 R; 200/16 F

[58] Field of Search ..... 333/81 A, 81 R; 200/6 BB, 6 B, 6 C, 11 D, 16 F, 254; 338/172, 173

[56] References Cited

U.S. PATENT DOCUMENTS

| | | | |
|---|---|---|---|
| 368,221 | 8/1887 | McDaniel | 200/254 |
| 1,751,398 | 3/1930 | Reamer et al. | 200/6 B |
| 3,908,178 | 9/1975 | Johnson et al. | 331/81 R |

*Primary Examiner*—Alfred E. Smith
*Assistant Examiner*—Harry E. Barlow
*Attorney, Agent, or Firm*—J. B. Hoofnagle, Jr.

[57] ABSTRACT

An attenuator, which can readily provide balanced as well as unbalanced attenuation in a plurality of external circuits, includes first and second circuit substrate devices and an actuating device associated with the circuit substrate devices. The first and second circuit substrate devices each provide variable magnitudes of attenuation to respective ones of the external circuits such as, for example, signal transmission lines. The actuating device couples the first in the alternative, and second circuit substrate devices simultaneously or the first and second circuit substrate devices separately to their respective external circuits so as to produce desired magnitudes of balanced or unbalanced attenuation in the external circuits.

17 Claims, 12 Drawing Figures

FIG. 1
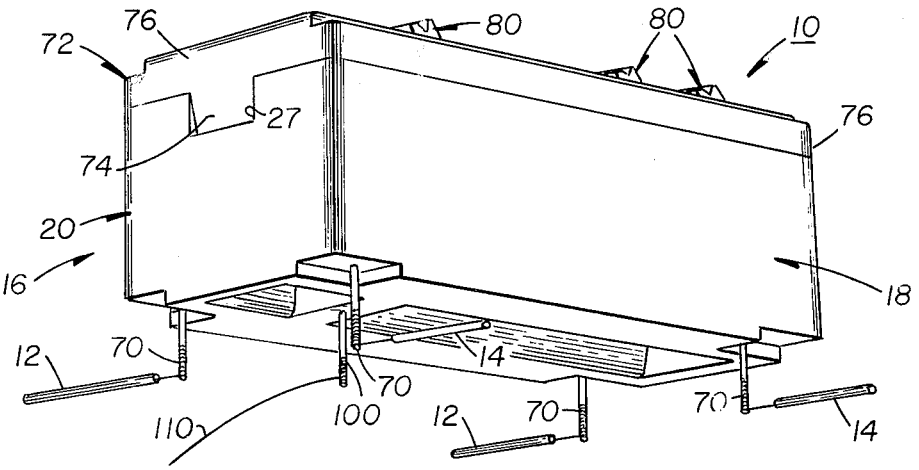
FIG. 2
FIG. 2A
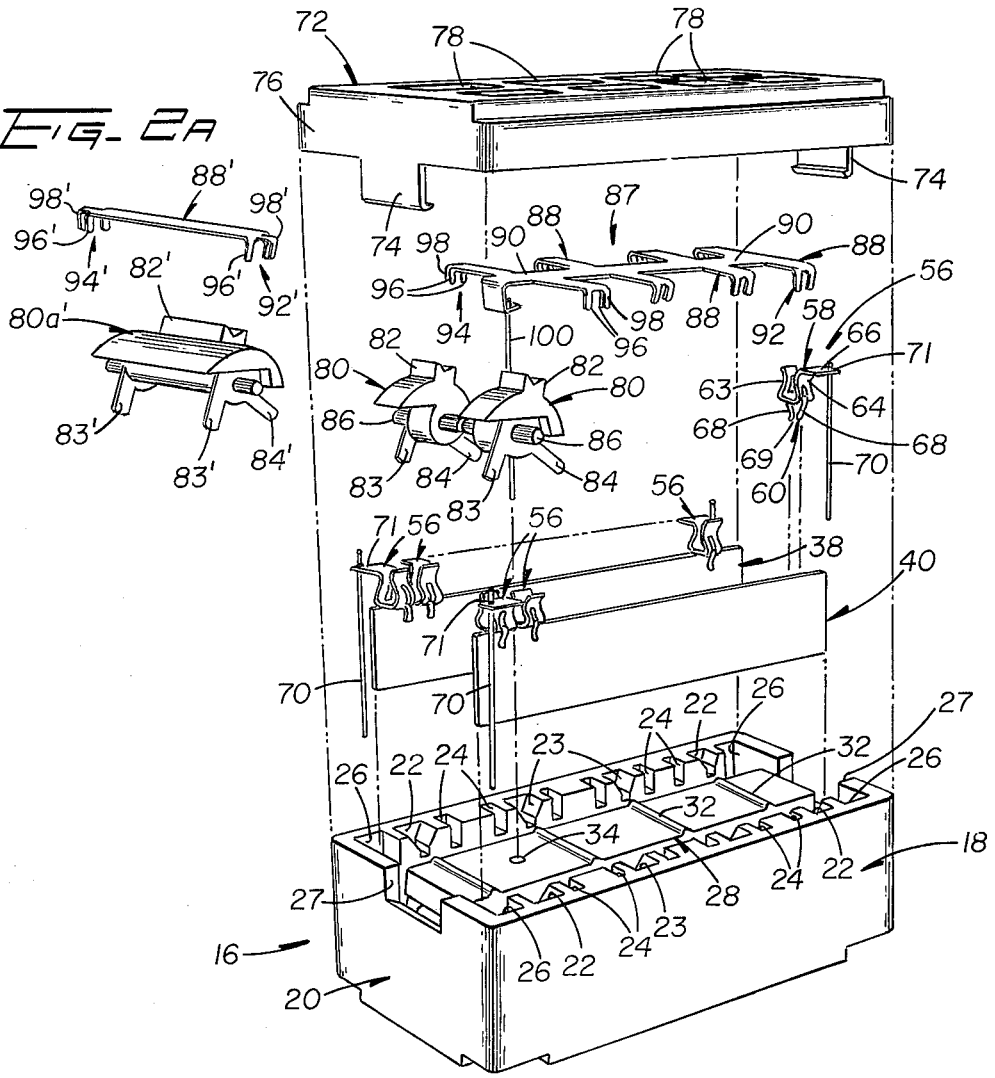

FIG. 3 UNBALANCED
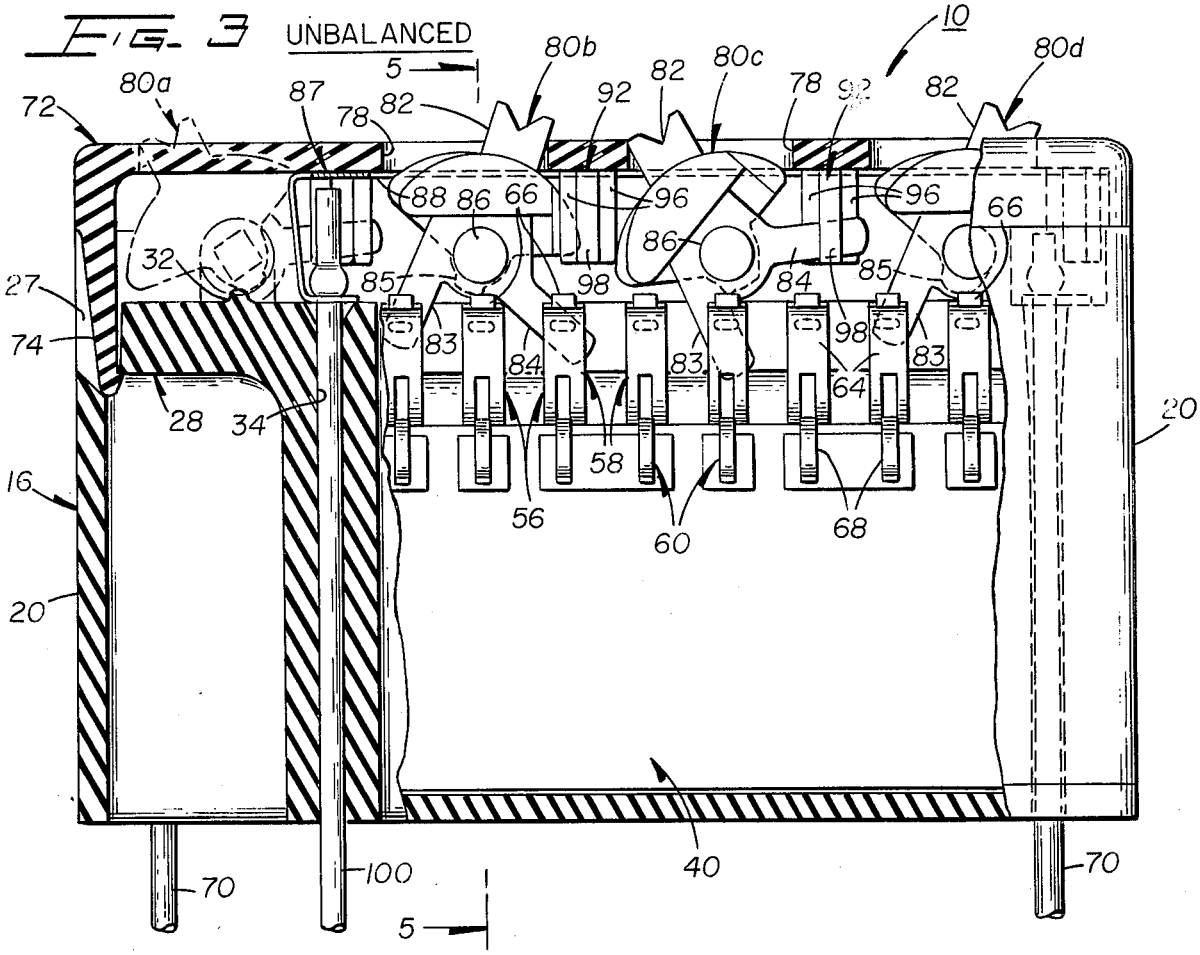
FIG. 4 UNBALANCED
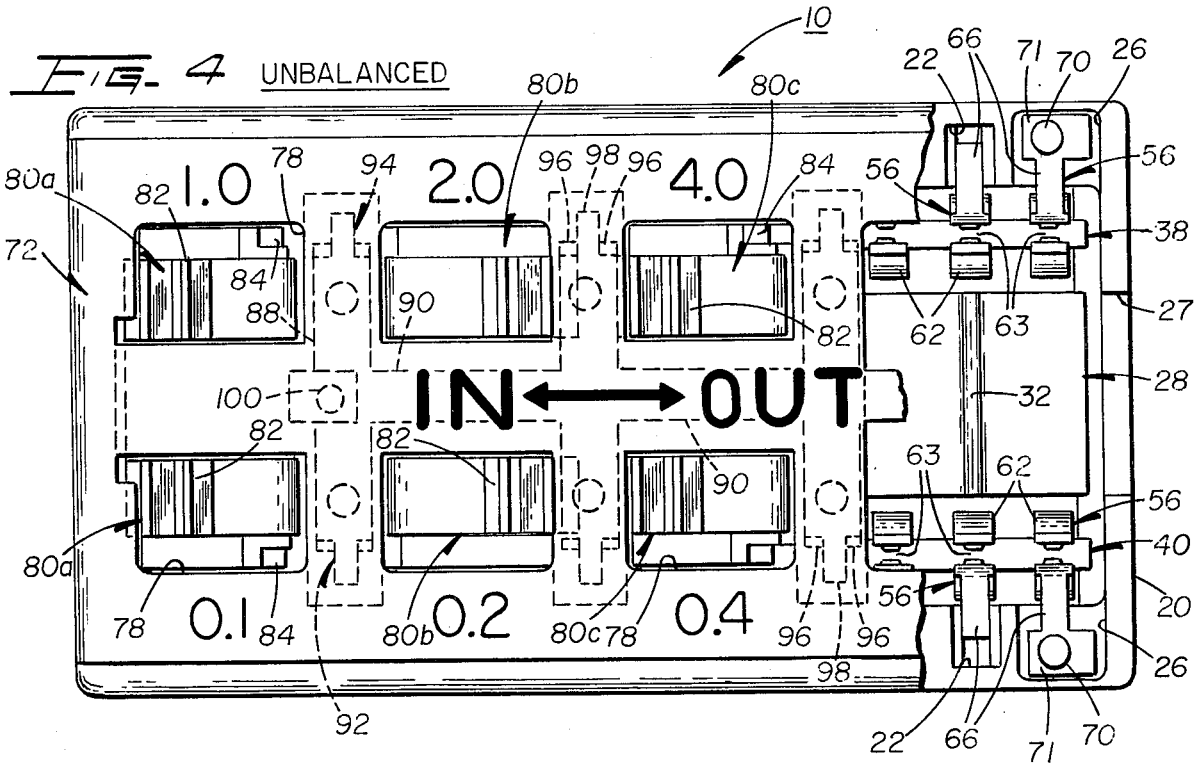

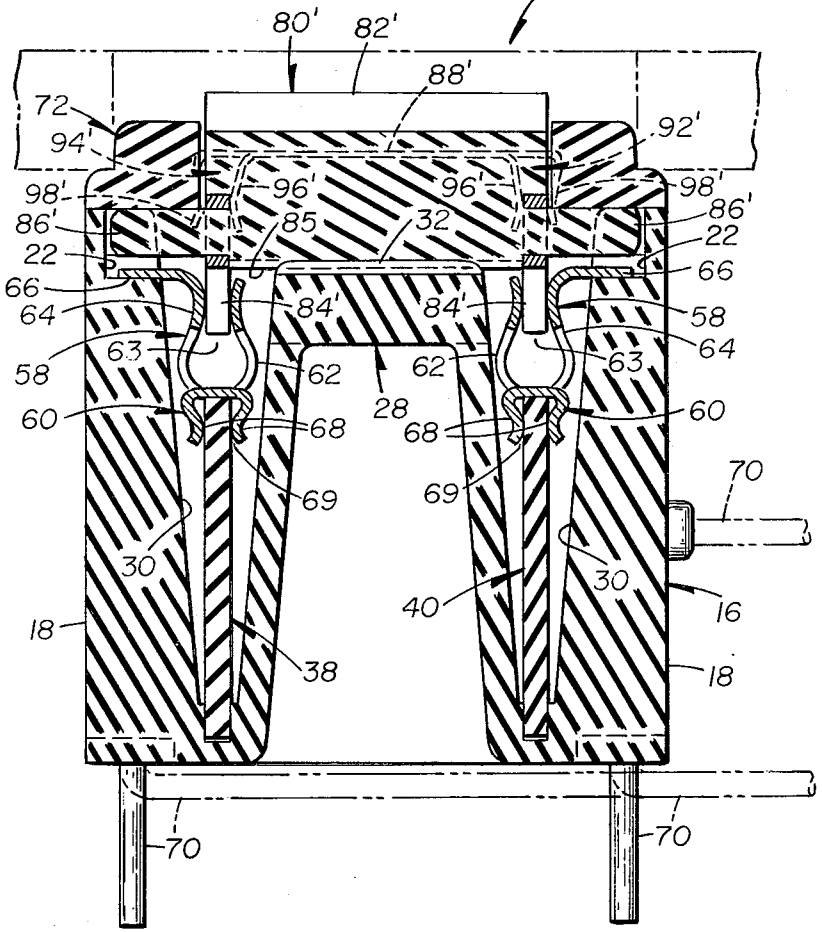
FIG. 8 BALANCED
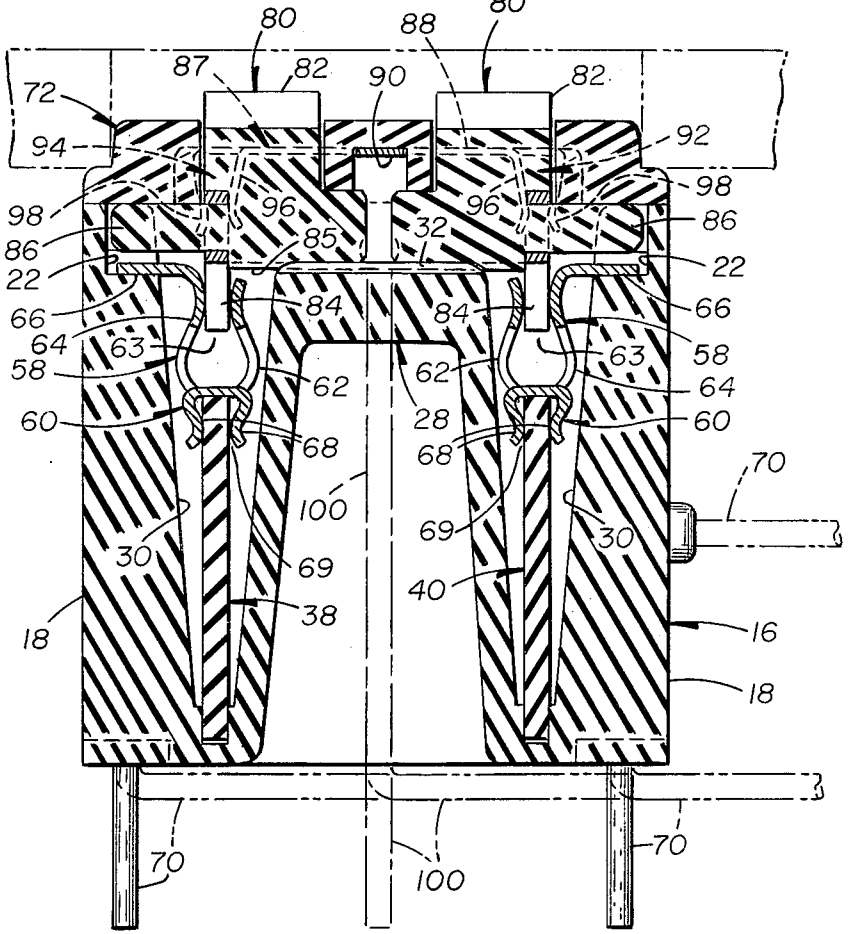
FIG. 5 UNBALANCED

FIG. 6 BALANCED
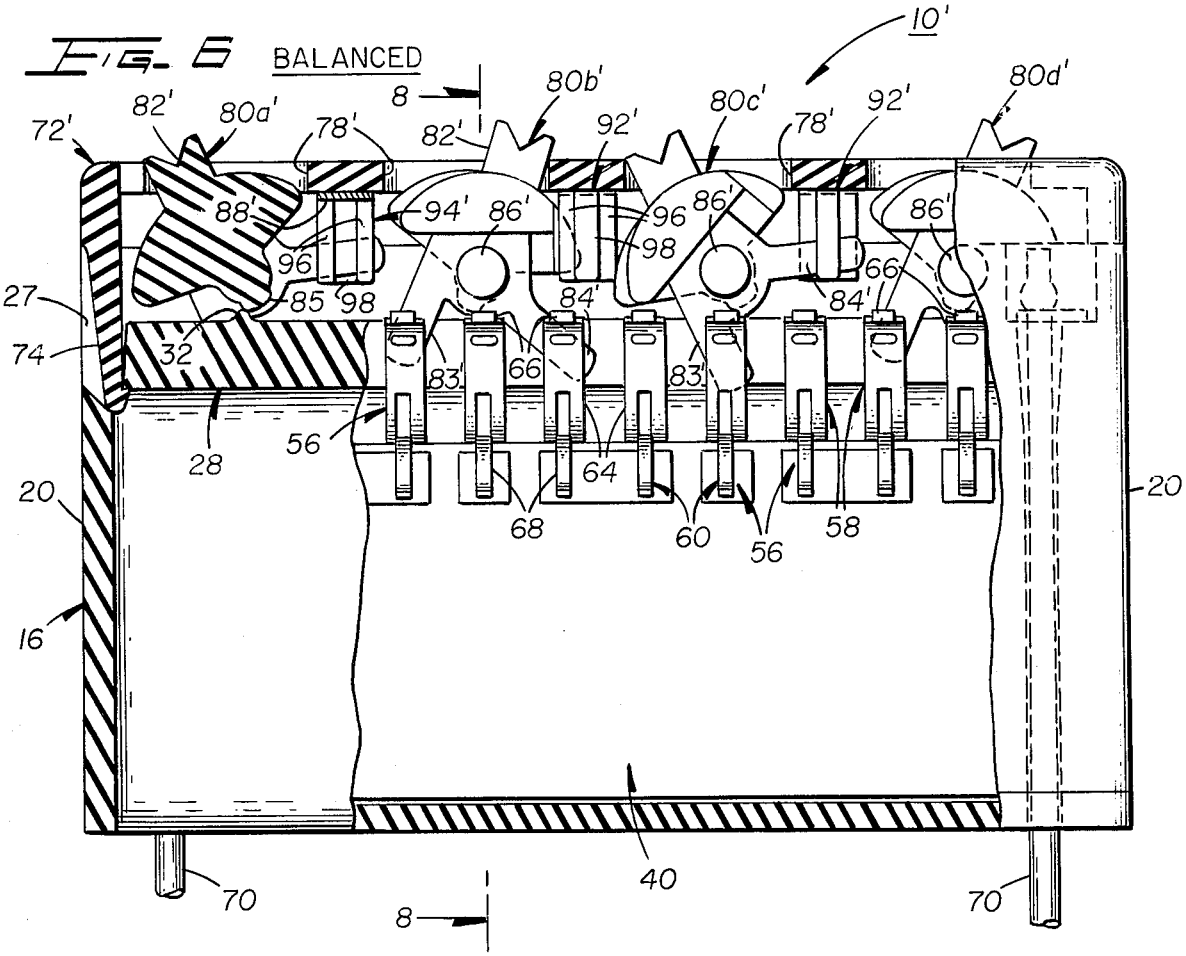
FIG. 7 BALANCED
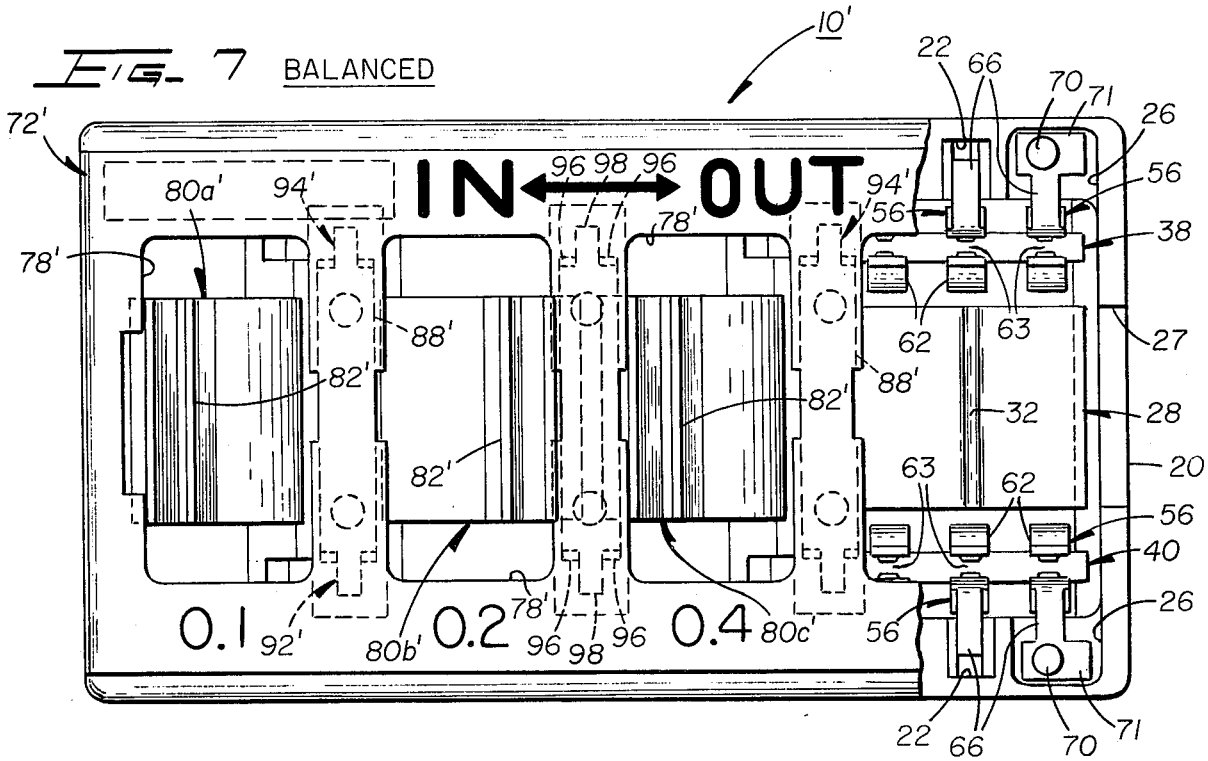

UNIVERSAL ATTENUATOR

BACKGROUND OF THE INVENTION

1. Field of the Invention

This invention relates to an attenuator for simultaneously providing attenuation in a plurality of external circuits and more particularly to an attenuator that can be utilizied to provide selectively either balanced or unbalanced attenuation in a plurality of external circuits.

2. Description of the Prior Art

In providing attenuation in electrical systems, such as, for example, when attenuation is required in transmission lines, it often becomes necessary to provide identical magnitudes as well as different magnitudes of attenuation to the respective transmission lines. A transmission system may be of either a balanced design, i.e., has equal currents flowing in each line of the transmission pair, or an unbalanced design, i.e., have unequal currents flowing in each line of the transmission pair. The transmission system design dictates the type of attenuation design required to adjust the transmission signals of the desired levels.

In prior art attenuator arrangements, balanced and unbalanced attenuation is provided in a given transmission system by utilizing attenuator structures which provide respective designated magnitudes of attenuation for that type transmission line design. Since individual attenuators are provided for each transmission line, the number of different attenuator structures that can be required for providing the balanced and unbalanced attenuation can be relatively large and expensive. Additionally, when providing balanced attenuation to the transmission lines, a problem can be created if care isn't taken to insure that the same magnitude of attenuation is provided in each of the respective transmission lines. Accordingly, it is desirable to provide an attenuator design concept which will minimize the number of different attenuator structures required in providing both balanced and unbalanced attenuation.

SUMMARY OF THE INVENTION

An attenuator structure, in accordance with this invention, for providing simultaneously attenuation in a plurality of external circuits includes a first support member and a second support member assembled with the first support member. Circuit means supported by the first support member includes attenuating circuits which are selectively connectable to the external circuits to produce attenuation of variable preselected magnitudes in the external circuits. Means are provided, including selectively engageable electrically conductive members mounted on the first and second support members, for selectively connecting the attenuating circuits on the circuit means to the external circuits to produce variable preselected magnitudes of attenuation in the external circuits.

BRIEF DESCRIPTION OF THE DRAWINGS

Advantages of the present invention will be apparent from the following detailed description when considered in conjunction with the accompanying drawings in which:

FIG. 1 is an enlarged isometric view of an attenuator assembly embodying certain principles of the invention;

FIG. 2 is an exploded isometric view illustrating a first embodiment of the attenuator assembly illustrated in FIG. 1, for providing unbalanced or balanced attenuation in a plurality of external circuits;

FIG. 2A is an exploded isometric view of a coupling assembly which can be used in a second embodiment of the attenuator assembly of FIG. 1, for providing balanced attenuation in a plurality of external circuits;

FIG. 3 is a side elevational view of the first embodiment of the attenuator assembly illustrated in FIGS. 1 and 2 which has been partially broken away;

FIG. 4 is a plan view of the first embodiment of the attenuator assembly;

FIG. 5 is a cross-sectional view of the first embodiment of the attenuator assembly taken substantially along line 5—5 of FIG. 3;

FIG. 6 is a side elevational view of the second embodiment of the attenuator assembly illustrated in FIG. 1, utilizing the coupling assembly shown in FIG. 2A, which has been partially broken away;

FIG. 7 is a plan view of the second embodiment of the attenuator assembly;

FIG. 8 is a cross-sectional view of the second embodiment of the attenuator assembly, taken along line 8—8 of FIG. 6;

DETAILED DESCRIPTION

Figure 9:
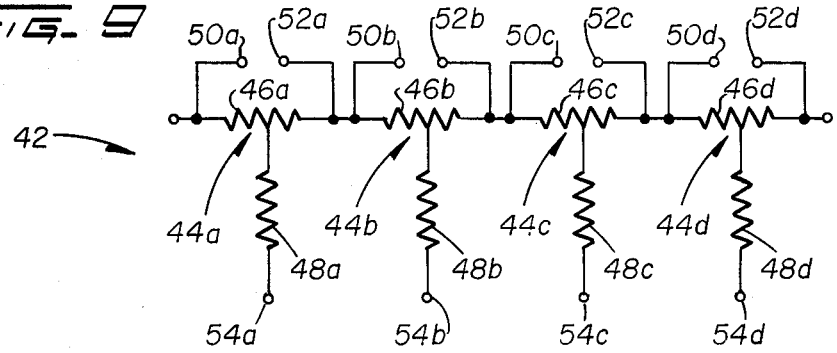
FIG. 9 is a circuit schematic illustrating a circuit.

Referring to FIG. 1, a universal attenuator assembly, generally designated by the numeral 10, is designed to be electrically coupled to first and second external circuit elements, such as, for example, first and second transmission lines 12 and 14. The universal attenuator assembly 10 may be either of the balanced or unbalanced type. That is, the attenuator assembly 10 can be utilized in providing identical magnitudes of attenuation to each of the respective transmission lines 12 and 14 in a balanced condition or the attenuator assembly can be utilized to provide different magnitudes of attenuation to the respective transmission lines in an unbalanced condition.

Referring to FIG. 2, the universal attenuator assembly 10 embodying the principles of this invention includes a lower housing or support member, generally designated by the numeral 16, of an electrically insulating molded plastic material such as, for example, polyester. The lower housing 16 includes spaced side walls, generally designated by the numerals 18, and spaced end walls generally designated by the numeral 20. Each side wall 18 has a plurality of laterally formed, inwardly directed wedge-shaped seats 22 formed therein that are aligned with similarly formed corresponding wedge-shaped seats 22 in the opposite side wall. A rectangularly shaped connector-receiving slot 23 is formed at the bottom of each seat 22. A plurality of pairs of connector-receiving slots 24 are also formed in each side wall 18 with each pair being located between adjacent ones of the wedge-shaped seats 22. Vertically extending stem-receiving slots 26, which are formed at each end of the side walls 18, extend downwardly through the housing 16. Each end wall 20 of the housing 16 includes a rectangularly shaped guide and locking tab-receiving channel 27 formed therein.

A longitudinally extending central partition, generally designated by the numeral 28, is integrally formed in the housing 16 between the side walls 18 thereof to form V-shaped channels 30 (FIGS. 5 and 8) within the housing. A plurality of ridges or fixed detents 32 are formed on the partition 28 in alignment with the wedge-shaped seats 22 formed in the partition 28 and extends downwardly through the partition and the housing 16.

A pair of circuit substrates devices, generally designated by the numerals 38 and 40 are included in the attenuator assembly 10 to provide predetermined amounts of either unbalanced or balanced attenuation, to transmission lines 12 and 14, in a manner to be described. In this respect, the circuit substrate devices 38 and 40 each include a circuit 42 (FIG. 9) which can provide different resistive values in order to provide unbalanced attenuation in the transmission lines 12 and common line 110 and in the transmission line 14 and the common line or provide the same resistive values in order to provide balanced attenuation in the transmission lines 12 and 14. The circuit substrate devices 38 and 40, which are received in the lower portions of the V-shaped channels 30 (FIGS. 5 and 8), are supported and retained in the lower housing 16 as is best shown in FIGS. 5 and 8. The circuit substrate devices 38 and 40 may be constructed utilizing discrete components or fabricated utilizing printed circuit techniques, thin film technology or any other well-known circuit fabrication techniques.

Referring to FIG. 9, on side of each of the circuit substrate devices 38 and 40 (FIG. 5) includes a circuit, generally designated by the numeral 42. The circuit 42 includes a plurality of resistive T-networks, generally designated by the numerals 44*a*–44*d*, which are each for providing a designated amount of attenuation at a predetermined impedance. The amount of attenuation provided by each of the resistive T-networks 44*a*–44*d* will depend on the value of resistors 46*a*–46*d* and 48*a*–48*d* included in each respective resistive T-network. Each of the resistive T-networks 44*a*–44*d* of the circuit 42 includes a plurality of electrical nodes 50*a*–50*d*, 52*a*–52*d* and 54*a*–54*d* which facilitate the establishment of electrical connections to each of the resistive T-networks.

As illustrated in FIGS. 2, 5 and 8, two rows of dual clip integral electrical connectors, each generally designated by the numeral 56, are provided for facilitating electrical coupling to the circuit substrate devices 38 and 40 in the attenuator assembly 10. Each connector 56 may be formed from a flat piece of a conductive material, such as, for example, a copper nickel alloy. Each connector 56 includes first and second electrical clips generally designated by the numerals 58 and 60, respectively.

The first clip 58 of each connector 56 includes a pair of resilient fingers 62 and 64 each having a contact surface 63 formed at an upper end thereof. The resilient finger 64 of the first clip 58 terminates in a laterally extending support tab 66 which rests in a corresponding one of the housing slots 24 to support the connector in the lower housing 16. The second clip 60 of the connector 56 includes a pair of spaced resilient fingers 68 each having a contact surface 69 formed near a free end thereof.

Upper end portions of a plurality of electrical stems 70 (FIGS. 2, 3 and 6) extends through and are coupled to enlarged portions 71 of the support tabs 66 of the connectors 56 at opposite ends of each row of the connectors, such as, for example, by soldering, to electrically couple the circuit substrate devices 38 and 40 to the transmission lines 12 and 14 in a manner to be described.

The connectors 56 are connectable to the circuit substrate devices 38 and 40 via the second electrical clips 60 as is illustrated in FIGS. 2, 5 and 8. The contact surfaces 69 of the respective connectors 56 are located so as to electrically engage circuit nodes 50*a*–50*d*, 52*a*–52*d* and 54*a*–54*d* of each of the resistive T-networks 44*a*–44*d*. The electrical stems 70 of the connectors 56 which are coupled to nodes 50*a* and 52*d* are connectable to the transmission lines 12 and 14 (FIG. 1) to facilitate electrical coupling of the circuit substrates devices 38 and 40 to the respective transmission lines so that selective amounts of attenuation can be provided thereto.

The attenuator assembly 10 is also provided with an upper housing, generally designated by the numeral 72 (FIGS. 1, 2, 3 and 4), of the same electrically insulating molded plastic material as the lower housing 16. The upper housing 72 includes a plurality of resilient rectangular latches 74 which are formed on each end 76 thereof to cooperate with the guide slots 27 and end portions of the partition 28 in the lower housing 16, as shown at the left side of FIG. 3, so that the lower and upper housings can be releasably interlocked.

In the first embodiment of the invention in which the attenuator assembly 10 (FIGS. 2, 3, 4 and 5) provides unbalanced attenuation, the upper housing 72 is formed with two rows of parallel spaced openings 78 (FIGS. 3, 4 and 5) which are illustrated as horizontal rows in FIG. 4. A plurality of pairs of actuators, generally designated by the numerals 80*a*–80*d*, of the same electrically insulating, molded plastic material as the housings 16 and 72 have upper portions 82 which extend upwardly into the through ones of the openings 78 of the upper housing 72. Each of the actuators 80*a*–80*d* is provided with a pair of spaced electrically conductive integral shorting blades 83 and 84 which can be formed of any reliable conductive material shuch as, for example, copper. Each pair of actuators 80*a*–80*d* is mounted for independent pivotable movement on a common shaft 86 (FIG. 2) having opposite end portions which rest in the corresponding slots 22 in the lower housing 14. Each actuator 80*a*–80*d* also includes a protrusion 85 (FIG. 3) formed on a bottom surface thereof which cooperates with the projection 32 of the lower housing 16 to provide detented movement of the actuators.

An integrally formed terminal strip, generally designated by the numeral 87, including electrically conductive terminals, each generally designated by the numeral 88, is mechanically coupled by suitable means such as screws or plastic studs (not shown) to the underside of the upper housing 72 (FIG. 2 and 5). The conductive terminals 88 are electrically coupled together by a common conductive web 90 (FIGS. 2 and 5) which extend between each adjacent pair of terminals 88 and with which they are integrally formed. Each conductive terminal 88 is formed at opposite ends thereof with conductive clips, generally designated by the numerals 92 and 94. Each conductive clip 92 and 94 includes a pair of spaced, resilient side fingers 98 in a common plane and a central finger 96 (best shown in FIG. 5) in a plane spaced from the common plane and aligned with a space between the pair of resilient side fingers. The space formed between the central finger 96 and the side fingers 98 is designated to receive a corresponding one of the shorting blades 83 and 84.

An electrical stem 100 which is secured to one end of the terminal strip 87 extends downwardly through the aperture 34 in the housing partition 28 to facilitate the coupling of a common line 110 (FIG. 10) to the terminal strip. The electrically conductive terminals 88, the conductive members 90, the stem 100, the connectors 56 and the circuit substrate devices 38 and 40 cooperate to provide a circuit as shown in FIG. 10, for producing attenuation in the transmission lines 12 and common line 110 and 14 and common line 110.

Figure 10:
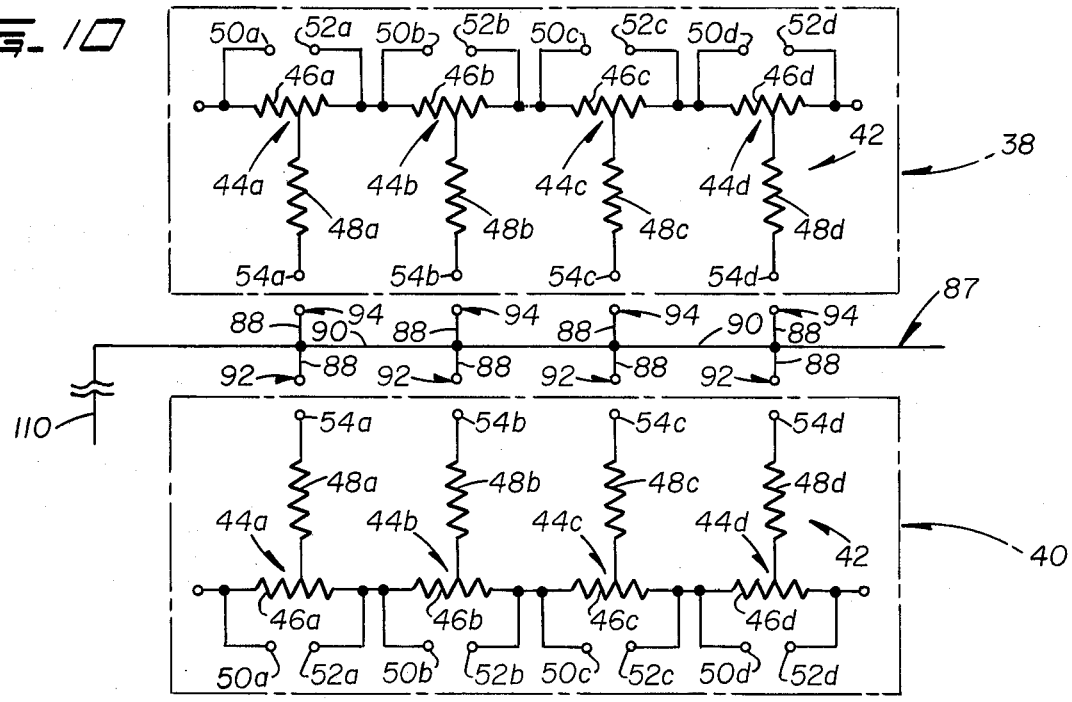
FIG. 10 is a circuit schematic illustrating a circuit arrangement for the first embodiment of the attenuator assembly, utilizing a pair of circuits as shown in FIG. 9.

The circuit of FIG. 10 is capable of providing unbalanced attenuation in the transmission lines 12 and 110 and 14 and 110 in the amounts illustrated by the indicia along the sides of the upper face of the upper housing 72 in FIG. 4, by utilizing the circuit substrate devices 38 and 40 in which corresponding ones of the resistive T-networks 44*a*–44*d* have different resistive values so as to produce unbalanced attenuation in the transmission lines when connected thereto as will subsequently be described. In the alternative, by making the corresponding ones of the resistive T-networks 44*a*–44*d* of the circuit substrate devices 38 and 40 of equal but specific value, for the desired attenuation the circuit of FIG. 10 can be used to provide balanced attenuation in the transmission lines 12 and 14.

As is illustrated in FIG. 3 when the attenuator assembly 10 is assembled, the circuit substrate devices 38 and 40 are positioned into the respective channels 30 in the lower housing 16. This will permit the shorting blades 83 and 84 of the actuators 80*a*–80*d* (FIG. 4) to be aligned ultimately to engage the corresponding clips 58 of adjacent pairs of the connectors 56 which are coupled to the respective circuit substrate devices 38 and 40 and will permit the shorting blades 84 to be moved to engage the corresponding clips 92 and 94 of the conductive terminals 88.

The electrical stems 70 which are connected to the four end connectors 56 and which are coupled to the nodes 50*a* and 52*d* (FIG. 9) are positioned and extend into the corresponding vertically extending slots 26 (FIG. 2) so that free end portions thereof extend to a position external to the underside of the lower housing 16 as shown in FIG. 3 to permit these portions to be coupled to the respective transmission lines 12 and 14 (FIG. 1).

The shafts 86 of the actuators 80*a*–80*d* are then placed in the corresponding grooves 22 on the lower housing 16 to provide for pivotable movement of the actuators on the lower housing. The upper housing 72 then is aligned with and coupled to the lower housing 16 via the latches 74 and guide slots 27 in the upper and lower housings, respectively, so that the upper portions 82 of the actuators 80*a*–80*d* extend into the openings 78 in the upper housing. When the upper housing 72 is assembled with the lower housing 16, the electrical stem 100 which is connected to terminal strip 87 extends downwardly through the aperture 34 in the partition 28 so that it can be coupled to the common line 110 (FIG. 10).

As is illustrated in phantom in FIG. 5, the stems 70 (FIG. 5) and the stem 100 (FIG. 8) may also be constructed to extend from the lower housing 16 in a lateral direction to permit coupling of the external circuit to the attenuator in this manner.

When it is desired to provide unbalanced attenuation in the transmission lines 12 and 110 and 14 and 110 utilizing the first embodiment of the invention shown in FIGS. 2, 3–5 and 10, the appropriate actuators 80*a*–80*d* associated with the respective circuit substrate devices 38 and 40 having corresponding resistive networks of different values are pivoted, such as, for example, the actuator 80*c* (FIGS. 3 and 4) associated with the circuit 42 (FIG. 10) on the circuit substrate device 38 (FIGS. 4 and 10). When the actuator 80c is pivoted in a counterclockwise direction as indicated in FIG. 3 and to the left as indicated in FIG. 4, the shorting blades 83 and 84 (FIG. 3) will engage the clip 58 of the connector 56 coupled to the node 54*c* (FIG. 10) of the circuit 42 on circuit substrate device 38 and the clip 94 of the corresponding electrical terminal 88 in the upper housing 72. This will establish a completed current path between the transmission line 12 and the common line 110 (FIG. 10) through portions of the resistor 46c and the resistor 48c of the circuit 42 on circuit substrate device 38. As a result, a predetermined amount of attenuation, for example, 4.0 db as illustrated in FIG. 4, will be provided in the transmission line 12. Similarly, the actuators 80*a*, 80*b* or 80*d* associated with the circuit substrate device 38 could be pivoted in this manner to provide a different magnitude of attenuation to the transmission line 12 or one or more of the actuators 80*a*–80*d* and associated with the circuit substrate device 40 could be pivoted to provide different magnitudes of attenuation to the transmission line 14.

With further reference to FIGS. 2, 3, 5 and 10 attenuation may be removed from or taken out of either of the transmission lines 12 or 14 by pivoting the appropriate actuators 80*a*–80*d* in the other or clockwise direction as viewed in FIG. 3 and the right as viewed in FIG. 4, such as, for example, as is illustrated by the actuator 80b associated with the circuit substrate 38 in FIGS. 3 and 4. Pivoting of the actuator 80*b* as is illustrated in FIGS. 3 and 4 will open a connection between the nodes 54*b* (FIG. 10) of the circuit substrate device 38 and the associated terminal 88 by removing the shorting bars 83 and 84 from engagement with the associated clip 58 of the connector 56 and the clip 94 of the associated terminal 88. Simultaneously, the shorting bars 83 and 84 will engage clips 58 coupled to the nodes 50*b* and 52*b* (FIG. 10) of the resistive T-network 44*b* of the circuit substrate device 38. This will short out the resistor 46*b* of the resistive T-network 44*b*. As a result, attenuation provided by the resistive T-network 44b of the circuit substrate device 38 will be removed from the transmission line 12. Similarly, the other actuators 80*a*–80*d* associated with each of the circuit substrates 38 and 40 may be pivoted in the same manner as the actuator 80*b* of the circuit substrate 38 to remove the respective amounts of attenuation provided by the resistive T-networks 44*a*–44*d* associated therewith from the respective transmission lines 12 and 14.

As a result of this arrangement, different magnitudes of attention can be provided to the respective transmission lines 12 and 110 and 14 and 110 thereby allowing the establishing of unbalanced attenuation in the respective transmission lines as noted above.

Figure 11:
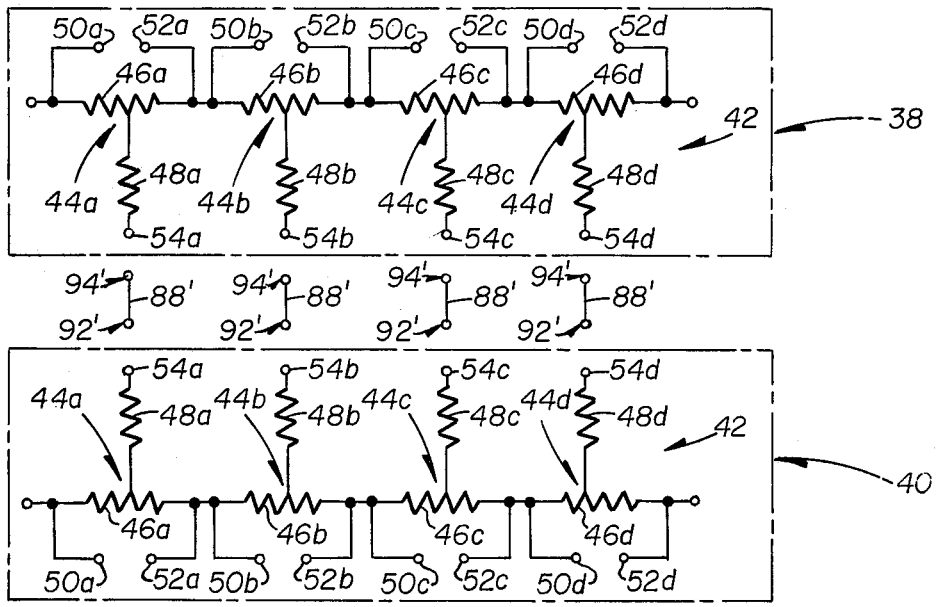
FIG. 11 is a circuit schematic illustrating a circuit arrangement for the second embodiment of the attenuator assembly, utilizing a pair of circuits as shown in FIG. 9.

In a second embodiment of the invention, an attenuator assembly 10' (FIGS. 2A, 6, 7 and 8) provides balanced attenuation. The attenuator assembly 10' is structurally similar to the attenuator assembly 10 and includes an upper housing 72', which is similar in construction to the upper housing 72 (FIG. 2). The upper housing 72' is formed with a single row of spaced openings 78' which are clearly visible in FIG. 7 and which extend essentially from side to side of the upper housing. In this embodiment, a plurality of actuators 80a'λ -80d' (FIGS. 2A, 6 and 7) of the same electrically insulated molded plastic as the actuators 80a–80d are provided with upper portions 82' that extend upwardly into the through the corresponding openings 78' in the upper housing 72'. Each of the actuators 80a'–80d' include two integrally connected, conductive shorting blades 83' and 84' formed on each end of the actuator. Each of the actuators 80a'–80d' is mounted for pivotable movement on a shaft 86' formed therewith, and having end portions which rest in the corresponding grooves 22 (FIG. 2) in the lower housing 16. The upper housing 72' in this embodiment also supports a plurality of electrically isolated conductive terminals 88' (FIGS. 2A, 6 and 7) which are mechanically coupled to the underside of the upper housing (FIG. 8). Each of the terminals 88' is formed with conductive clips 92' and 94' at opposite ends thereof to receive corresponding ones of the shorting blades 83' and 84'. The conductive terminals 88', the connectors 56 and the circuit substrate devices 38 and 40 cooperate to provide a circuit as shown in FIG. 11, for producing balanced attenuation in the transmission lines 12 and 14.

When it is desired to provide balanced attenuation in the transmission lines 12 and 14, utilizing the second embodiment of the invention shown in FIGS. 2A, 6, 7, 8 and 11 is utilized by pivoting the appropriate actuators 80a'–80d' of the attenuator assembly 10' such as, for example, the actuator 80c' (FIGS. 6 and 7). When the actuator 80c' is pivoted in the direction indicated (counterclockwise in FIG. 6 and to the left in FIG. 7), the pair of shorting bars 84' at its opposite ends will engage the clips 58 of the connectors 56 coupled to each node 54c (FIGS. 7 and 11) of the resistive T-networks 44c on each circuit substrate device 38 and 40 (which have corresponding resistive networks of equal value) and the pair of shorting bars 84' will engage the clips 92' and 94' of the corresponding conductive terminal 88' mounted in the upper housing 72'. This will establish a connection between the nodes 54c (FIG. 11) in each of the resistive T-networks 44c thereby closing a circuit therebetween and establishing a current path through portions of the resistors 46c and the resistors 48c to the respective transmission lines 12 and 14. As a result, identical amounts of attenuation will be provided in each of the transmission lines 12 and 14. Each of the other actuators 80a', 80b' and 80d' when pvioted in the direction of the actuator 80c', also will cause the pairs of shorting bars 83' and 84' associated therewith to establish a connection between the corresponding nodes 54a, 54b and 54d of each resistive T-network 44a, 44b and 44d, respectively, on the circuit substrate devices 38 and 40 to thereby provide predetermined identical amounts of attenuation to the transmission lines 12 and 14.

With further reference to FIGS. 2A, 6, 7, 8 and 11, attenuation may be removed from or taken out of the transmission lines 12 and 14 by pivoting the actuators 80a'–80d' in the other direction, such as, for example, as is illustrated by actuator 80b' in FIG. 6. Pivoting of the actuator 80b' in this direction (clockwise in FIG. 6 and to the right in FIG. 7) will open the connection between the nodes 54b of the resistive T-networks 44b (FIG. 11) on each circuit substrate devices 38 and 40 by removing the two pairs of shorting bars 83' and 84' from engagement with the associated clips 92b' and 94b' of the conductive terminal 88b in the upper housing 72'. Simultaneously, the two pairs of shorting bars 83' and 84' of the actuator 80b' will engage corresponding clips 58 (FIG. 6) of the connectors 56 which are coupled to the nodes 50b and 52b of the resistive T-networks 44b on the respective circuit substrate devices 38 and 40. This will short out the resistor 46b on each of the circuit substrate devices 38 and 40. As a result, attenuation provided by the resistive T-network 44b in each of the circuit substrate devices 38 and 40 will be removed from the transmission lines 12 and 14, respectively. The other actuators 80a'–80d' may be pivoted in a similar manner to remove the respective amounts of attenuation provided by the resistive T-networks 44a–44d associated therewith in each of the circuit substrate devices 38 and 40 from the transmission lines 12 and 14, respectively. As a result, in this embodiment of the attenuator assembly 10, balanced attenuation, i.e., identical amounts of attenuation, is provided in each of the transmission lines 12 and 14.

It should be understood that additional attenuation may be provided to the transmission lines 12 and 14 by including additional resistive T-networks 44a–44d in the circuits 42 on each of the circuit substrate devices 38 and 40 and providing the corresponding structural components that are required.

It should also be understood that the above-described embodiments are simply illustrative of this invention and that other embodiments thereof may be devised by those skilled in the art which embody the principles of the invention and fall within the spirit and scope thereof.

What is claimed is:

1. An attenuator for producing attenuation in a plurality of external circuits simultaneously, comprising:

a first support member;

a second support member assembled with the first support member;

circuit means supported by the first support member and having attenuating circuits selectively connectable to the external circuit for producing attenuation in each of the external circuits; and means for selectively connecting the attenuating circuits of the circuit means to the external circuits, the connecting means including first and second selectively engageable electrically conductive means mounted on the first and second support members, respectively.

2. An attenuator as defined in claim 1 wherein:

the first conductive means of the connecting means includes a plurality of conductive portions for providing electrical coupling to selected attenuating circuits of the circuit means, the conductive portions being mounted for movement on the first support member; and the second conductive means of the connecting means includes a connector selectively engageable by respective conductive portions of the first conductive means so that upon selective movement of the conductive portions of the first conductive means to engage the connector attenuation is provided to the external circuits.

3. An attenuator as defined in claim 2 wherein the first conductive means further includes:

a plurality of actuators mounted for movement on the first support member; and the plurality of conductive portions being coupled to respective ones of the actuators.

4. An attenuator as defined in claim 3 wherein the plurality of actuators which are supported on the first support member are captured between the assembled first and second support members.

5. An attenuator as defined in claim 3 wherein each of the plurality of conductive portions coupled to each of the plurality of actuators are a pair of spaced conductive integrally formed shorting bars.

6. An attenuator as defined in claim 5 wherein the connector of the second conductive means is a first connector and the connecting means further includes a plurality of second connectors coupled to selected attenuating circuits of the circuit means and wherein the attenuator further comprises a common shaft supported on the first support member and on which the plurality of actuators are mounted for independent pivotal movement so that upon selective movement of each of the actuators the respective pair of integrally formed shorting bars will engage a corresponding one of the second connectors coupled to a selected attenuator circuit of the circuit means and the first connector to thereby provide attenuation to the external circuits.

7. An attenuator as defined in claim 6 wherein the first connector includes a plurality of electrical clips, which are electrically coupled by a common conductive member, for receiving respective conductive portions of the first conductive means.

8. An attenuator as defined in claim 1 wherein:

the first conductive means of the connecting means includes a plurality of conductive portions for providing electrical coupling to selected attenuating circuits on the circuit means, the conductive portions being mounted for movement on the first support member; and the second conductive means of the connecting means includes a plurality of electrically isolated connectors, each having portions for receiving respective conductive portions of the first conductive means so that upon selective movement of the conductive portions of the first conductive means to engage the corresponding connectors attenuation is provided to the external circuits.

9. An attenuator as defined in claim 8 wherein the first conductive means further includes:

a plurality of actuators mounted for movement on the first support member; and the plurality of conductive portions being coupled to respective ones of the actuators.

10. An attenuator as defined in claim 3 wherein the plurality of actuators which are mounted on the first support member are captured between the assembled first and second support members.

11. An attenuator as defined in claim 9 wherein each of the plurality of conductive portions coupled to each of the plurality of actuators are a pair of spaced conductive integrally formed shorting bars coupled to each end thereof.

12. An attenuator as defined in claim 11 wherein the plurality of electrically isolated connectors is a plurality of first electrically isolated connectors and the connecting means further includes a plurality of second electrically isolated connectors coupled to selected attenuating circuits of the circuit means so that upon selective movement of each of the actuators the respective pair of integrally formed shorting bars at each end thereof will engage a corresponding one of the second electrically isolated connectors coupled to a selected attenuating circuit of the circuit means and the corresponding one of the first electrically isolated connectors to thereby provide attenuation to the external circuits.

13. An attenuator for producing simultaneously attenuation in a plurality of transmission lines comprising:

a first support member;

a second support member assembled with the first support member;

circuit means positioned and supported in the first support member and having attenuating circuits selectively connectable to the transmission lines for producing attenuation of variable preselectable magnitudes in each of the transmission lines;

a plurality of connector means for providing selective coupling in the attenuating circuits of the circuit means; and movable electrically conductive means having first and second portions positionable in at least first and second positions for electrically coupling selected portions of a selected one of the attenuating circuits when in the first position and for electrically coupling a selected portion of a selected one of the attenuating circuits to a selected one of the plurality of connector means when in the second position so that upon selective movement of the electrically conductive means the attenuating circuits of the circuit means are selectively connected to provide the selected magnitudes of attenuation to the transmission lines.

14. An attenuator for producing attenuation in transmission lines comprising:

a first support member having a plurality of channels formed therein;

a second support member which is assembled with the first support member;

a plurality of circuit substrate devices, each of which is positioned and supported in a respective channel in the first support member, and each of which has attenuating circuits formed thereon, the attenuating circuits of each circuit substrate device being selectively connectable for producing attenuation of variable preselected magnitudes in the respective transmission line;

a plurality of electrical connectors for providing selective coupling in the attenuating circuits of the circuit substrate devices;

a plurality of actuators mounted for movement on the first support member and positionable in at least first and second positions; and a plurality of conductive shorting bar assemblies with each assembly including a pair of integrally formed shorting bars, each shorting bar assembly mechanically coupled to a corresponding one of the actuators with the pair of shorting bars of each assembly for electrically coupling selected portions of a selected attenuating circuit on a respective one of the circuit substrate devices when the corresponding actuator is in the first position, and for electrically coupling selected portions of the selected attenuating circuit to a selected one of the plurality of electrical connectors when the actuator is in the second position so that upon selected movement of one of the plurality of actuators, the attenuating circuits of the corresponding circuit substrate devices are selectively connected to provide selected magnitudes of attenuation to the respective transmission lines.

15. An attenuator as defined in claim 14 which further comprises:

a common conductive member electrically coupling the plurality of electrical connectors; and a plurality of shafts supported on the first support member with each shaft supporting for independent movement thereon a respective pair of the plurality of actuators so that, upon selected movement of each of the plurality of actuators, the positioning of the shorting bars facilitates the establishment of selected magnitudes of attenuation in the attenuator circuits which is coupled to the transmission lines.

16. An attenuator as defined in claim 14 wherein:

each of the plurality of actuators has coupled to each of two spaced portions thereof one of the shorting bars assemblies; and each of the plurality of electrical connectors includes first and second integrally connected electrical contacts each of which are positioned for engagement by one shorting bar of a corresponding one of the pair of shorting bars so that, upon selective movement of each of the plurality of actuators, the corresponding pairs of shorting bars are selectively connected in the attenuating circuits of the circuit substrate devices to thereby provide attenuation to the transmission lines.

17. An attenuator as defined in claim 14 wherein the plurality of actuators mounted on the first support member are captured between the assembled first and second support members.

* * * * *